United States Patent [19]

Bithell

[11] Patent Number: 5,039,257

[45] Date of Patent: Aug. 13, 1991

[54] MINE ROOF SUPPORTS

[75] Inventor: Tom C. Bithell, Chorley, United Kingdom

[73] Assignee: Gullick Dobson Limited, Lancashire, England

[21] Appl. No.: 521,979

[22] Filed: May 11, 1990

[30] Foreign Application Priority Data

May 18, 1989 [GB] United Kingdom ..... 8911468

[51] Int. Cl.[5] ..... E21D 23/04; E21D 15/44

[52] U.S. Cl. ..... 405/297; 405/295; 405/298; 405/299

[58] Field of Search ..... 405/288, 290–299; 294/31–33; 91/170 MP

[56] References Cited

U.S. PATENT DOCUMENTS

| | | | |
|---|---|---|---|
| 4,217,067 | 8/1980 | Lagodka et al. | 405/296 |
| 4,940,363 | 7/1990 | Brown et al. | 405/296 |

FOREIGN PATENT DOCUMENTS

| | | | |
|---|---|---|---|
| 2804864 | 8/1979 | Fed. Rep. of Germany | 405/295 |
| 3241894 | 3/1984 | Fed. Rep. of Germany | 405/290 |
| 3236907 | 4/1984 | Fed. Rep. of Germany | 405/290 |
| 3638695 | 5/1988 | Fed. Rep. of Germany | 405/290 |
| 2067640 | 7/1981 | United Kingdom | 405/291 |

*Primary Examiner*—Dennis L. Taylor
*Assistant Examiner*—John A. Ricci
*Attorney, Agent, or Firm*—Nixon & Vanderhye

[57] ABSTRACT

Mine roof support comprising a base including a pair of skids, a roof engaging canopy, jacks acting between the base and the canopy, an auxiliary jack connected to the base for lifting or lowering at least part of the base when the support advances and a lost motion arrangement connected between the base and the auxiliary jack for aiding movement of the base and the roof engaging canopy toward each other. The lost motion arrangement is connected to each of the skids by a pivotal connection which permits the front end of one skid to move vertically to a limited extent with respect to the front end of the adjacent skid.

13 Claims, 2 Drawing Sheets

MINE ROOF SUPPORTS

BACKGROUND TO THE INVENTION

The invention relates to mine roof supports.

DESCRIPTION OF THE PRIOR ART

Mine roof supports are well known and generally comprise a base, a roof engaging canopy, and jack means acting between the base and canopy to urge the canopy into supporting engagement with a mine roof.

There may be additional shield means at the rear of the support and there may be guide linkage means acting between the base and the shield means.

Generally the base has advancing means connected thereto, including an advancing ram, for connection to a mine conveyor, the ram being operable to advance the conveyor when the support is in its set position engaging the mine roof, and subsequently to advance the support, when the conveyor is in a new position and the support has been freed from the mine roof by retraction of the jack means. In some situations the advancing ram may operate through an associated component known as a relay bar.

It is occasionally necessary to provide means for lifting the front of the base as the support moves forwardly, to assist the support in sliding over debris or other obstructions on the mine floor. Generally such means comprises auxiliary jack means connected to the support and operable to bear downwardly on a part of the advancing means, thus providing an up-thrust on the support.

However, this auxiliary jack means, although it can be made relatively short in length, nevertheless extends for a significant distance in the upward direction, even when fully retracted. This in turn limits the extent to which the base and canopy can move towards one another and in known arrangements, if the base and canopy are to be fully collapsed together for transportation or storage, it may be necessary to remove the auxiliary jack means, or a part thereof.

OBJECT OF THE INVENTION

It is the object of this invention to avoid or reduce the above mentioned problem.

SUMMARY OF THE INVENTION

According to the invention, such problems are avoided or reduced by providing a mine roof support comprising a base, a roof engaging canopy, jack means acting between the base and canopy, and auxiliary jack means connected to the base for use in lifting or lowering at least part of the base for example if it meets an obstruction when the support advances, the connection between the base and the auxiliary jack means including lost motion means.

The lost motion means may increase the ability of the base and canopy to move towards one another, thus assisting vertical compaction of the support for transportation or storage.

The lost motion means may be used to prolong the contact between the auxiliary jack means and support advancing means over a greater distance than would be available solely from the auxiliary jack means.

The auxiliary jack means may be arranged to act between part of a generally horizontally extending advancing means of the support and an abutment member extending across and above the said part.

The advancing means may comprise an advancing ram and a relay bar.

The abutment member may comprise a retention plate.

The auxiliary jack means may comprise a generally cylindrical ram, and the ram may act within a housing, one end of which is bridged by the retention plate.

Preferably the lost motion is provided by a second housing which surrounds the first housing and is slidable therealong between a pair of stops.

The housings may comprise tubes.

One stop may comprise an extension of the retention plate.

The second stop may comprise a projection on the inner housing.

The projection may comprise an annular flange.

The annular flange or other projection may be arranged to shear off if it is subjected to excess load, to protect the auxiliary jack means and the advancing means.

The invention is particularly useful with certain forms of mine roof support, having a base in the form of a pair of parallel skids between which the advancing ram is arranged.

With such a support, the auxiliary jack means and lost motion means can conveniently be connected between the two skids.

Various forms of mine roof support are known, having a base in the form of parallel skids, in which the skids are linked together in various ways to prevent or control horizontal or vertical displacement of one skid with respect to the other.

Generally, it is desirable to prevent or substantially restrict any relative vertical or horizontal displacement between the rear ends of the skid and various arrangements are known for providing the necessary degree of control, including rigid, welded rear bridges, or the use of torsion resistant inter-connecting rear links.

However, there can be advantages in allowing each skid to pivot vertically about its rear end, with respect to the other skid, thus enabling the front end of each skid to move vertically, to a limited extent, with respect to the front end of the other skid. For example, this allows the base to shape itself, to a limited extent, to an uneven mine floor, thus bringing about better distribution of load.

Thus, in a preferred embodiment of the invention, the lost motion means is connected to each of the skids by a pivotal connection which permits the front end of one skid to move vertically to a limited extent with respect to the front end of the adjacent skid.

Preferably the distance between the pivotal connections is fixed. This has the added advantage that the lost motion means is able to perform a triple function. In addition to providing the necessary lost motion according to the basic principal of the invention, it also permits the said relative movement in the vertical direction, but substantially prevents any relative movement of the front ends of the skids in the transverse horizontal direction. This in turn reduces or prevents any tendency for the front ends of the skids to splay apart as the support moves forwardly through mine floor debris.

The pivotal connections may each be formed by a projecting lug on the said outer tube which lug is connected by a pivot pin to a corresponding lug on the support base.

The invention also involves an embodiment in which the base comprises a pair of pontoons interconnected by at least one bridge, the auxiliary jack means acting between the bridge and support advancing means.

Other objects and advantages of the invention will be apparent from the following description of an embodiment of the invention, given by way of example.

DESCRIPTION OF PREFERRED EMBODIMENT

Figure 1:
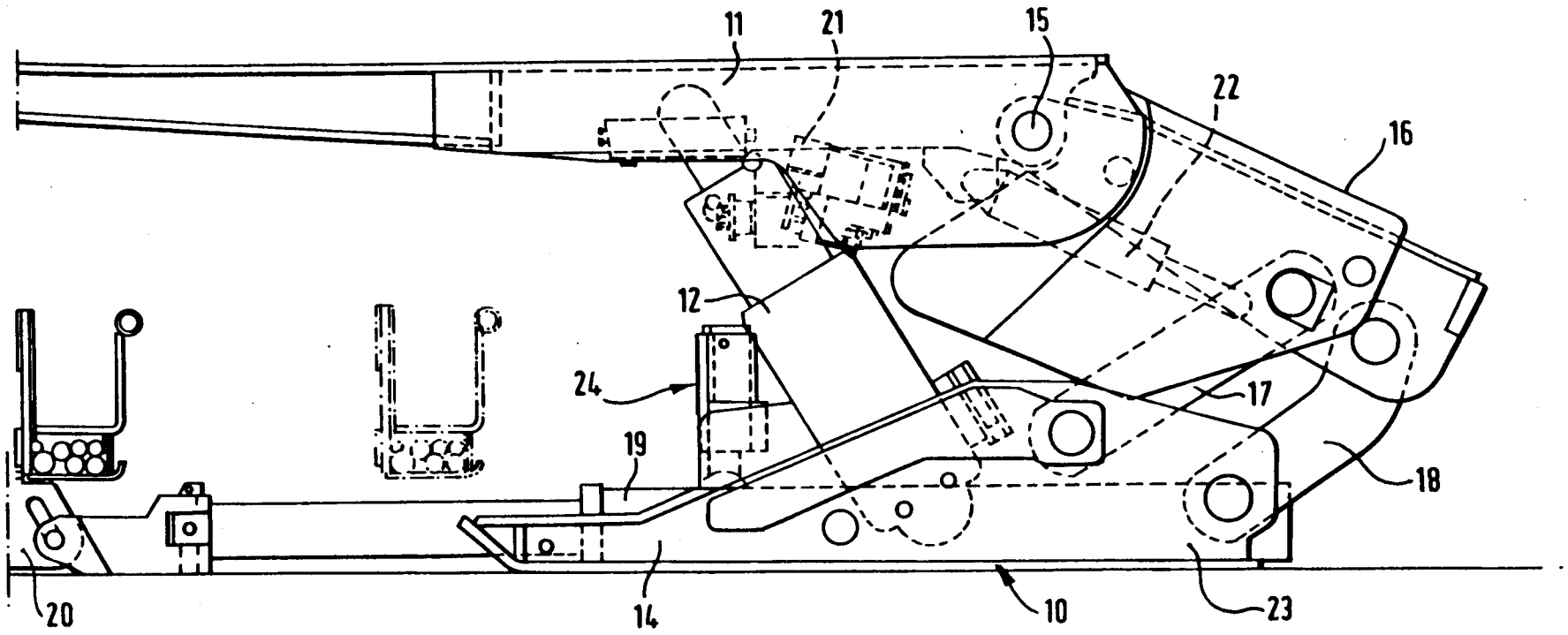
FIG. 1 is a side view of an embodiment of hydraulic mine roof support according to the invention.

The support shown in the Figures comprises a base 10, a roof engaging canopy 11, and jack means in the form of two, side by side, hydraulic legs, one of which can be seen at 12 in FIG. 1.

The base 10 comprises a pair of spaced-apart parallel skids 13 and 14.

Pivotally connected to the canopy 11 at 15 is a rear shield 16 and each of the skids 13 and 14 is pivotally linked to the shield 16 by its own pair of rear links 17 and 18. Each of the links 17 and 18 is pivotally connected to the associated skid and is also connected to the shield 16. The links 17 and 18 comprise a linkage of the type known as a lemniscate linkage and this controls the movement of the canopy 11 with respect to the base 14, in a known manner, as the hydraulic legs extend or retract.

Mounted between the skids 13 and 14 is a forwardly extending hydraulic advancing ram 19, for use in connecting the support to a mining conveyor, part of which can be seen at 20.

The support also has other equipment, such as valve gear 21, which need not be described in detail, and a compensating ram 22 for use in adjusting the distribution of load to the canopy 11.

The basic functions of the support are generally conventional, in that the hydraulic legs can be used to set the support, causing the canopy 11 to come into load bearing engagement with a mine roof. After a web of coal or other mineral has been removed from in front of the conveyor 20 by the passage of a mining machine, the advancing ram 19, together with the advancing rams of adjacent, similar supports, can be used to advance the conveyor 20 to a new position. Mine roof supports can then be selectively freed from the roof by lowering of the hydraulic legs 12 and can be then drawn forward to a new position using the ram 19.

This particular support has a novel means for raising the front ends of the skids 13 and 14, to assist their passage over debris or other projections in the mine floor.

The rear ends 23 of the skids are held substantially rigid with respect to one another, in the horizontal and vertical directions, by any convenient means, such as, for example, a rear bridge, or torsion resistant bracing between one or both pairs of links 17 and 18, for instance in the form of a torsion box.

Figure 2:
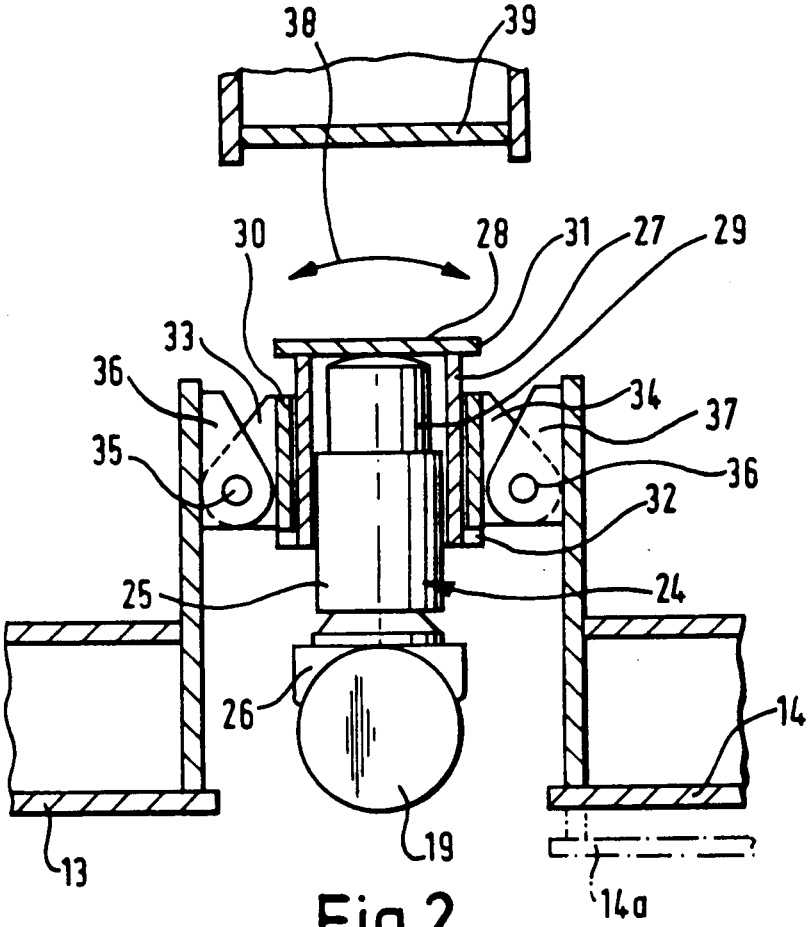
FIG. 2 is a front view of part of the support, shown in a working position.

Although horizontal and vertical relative movement is substantially prevented, the rear connections still permit limited pivotal movement of one skid with respect to the other, about a horizontal transverse axis passing through the rear of the skids, and so the front end of each skid is free to move in the upward direction, with respect to the front end of the opposite skid, to a limited extent. The limit of movement of the skid 14, relative the skid 13, is shown in FIG. 2 by the solid lines 14, and the chain lines 14*a*.

Such limited movement of one skid with respect to the other has certain advantages, for example in the distribution of load over an uneven mine floor.

The novel front lifting apparatus which is about to be described in detail has particular advantages in that it fulfills three functions. Not only does it provide the necessary lifting of the front ends of the skids, but it also accommodates the limited relative vertical movement of one skid with respect to the other, and at the same time ties the front ends of the skids together in the horizontal transverse direction, thus preventing the skids from splaying apart as the support moves through mine floor debris.

The novel base lifting apparatus comprises a short stroke hydraulic ram 24, the cylinder 25 of which has a shoe 26 which slidably engages on the support ram 19.

Surrounding the ram 24 is an inner tube 27, of cylindrical form, the upper end of which is closed by a retention plate 28 against which the piston rod 29 of the ram abuts.

The cylindrical outer sleeve 30 surrounds the inner sleeve 27. The sleeve 30 is shorter than the sleeve 27 and can slide therealong between end stops provided by the projecting edge 31 of the plate 28, and by a sheer flange 32 welded to the inner tube 27.

The outer tube 30 has a pair of projecting opposed lugs 33 and 34 and these are pivotally connected by pins 35 and 36 to corresponding lugs 36 and 37 on the skids 13 and 14.

The tube 30 and lugs 33 and 34 provide a longitudinally rigid link between the pivot pins 35 and 36 which ties the front ends of the skids together to prevent splaying, while permitting the limited relative vertical movement, via the pivot pins 35 and 36.

If the front end of one skid moves vertically with respect to the front end of the other skid, the tilting of the outer tube 30 causes corresponding tilting of the inner tube 27 and ram 24, and the arc marked 38 shows the maximum permissible angular movement of the ram 24 and associated components.

If it is desired to use the ram 24 to lift the front ends of the skid away from the mine floor, then the situation shown in the working position of FIG. 2 arises. A bottom plate 39 of the canopy 11 is well clear of the retention plate 28, even when the canopy 11 has been lowered from the mine roof sufficiently to permit the support to advance. Extension of the ram 24 causes the piston rod 29 to extend and raise the retention plate 28. The outer tube 33 is resting on the sheer flange 32 and when the plate 28 rises, it lifts with it the inner tube 27, the sheer flange 32, and hence the outer tube 30, lugs 33, 34, 36 and 37, and hence lifts the skids 13 and 14.

In this particular embodiment, the two tubes 27 and 30 provide a lost motion arrangement which increases the degree to which the base 10 and canopy 11 can be moved towards one another, when it is desired to collapse the support for transportation and storage. It will be appreciated that mine roof supports often have to be transported or manipulated in very confined spaces, and it is important to be able to reduce as much as possible the overall dimensions of a collapsed support.

Figure 3:
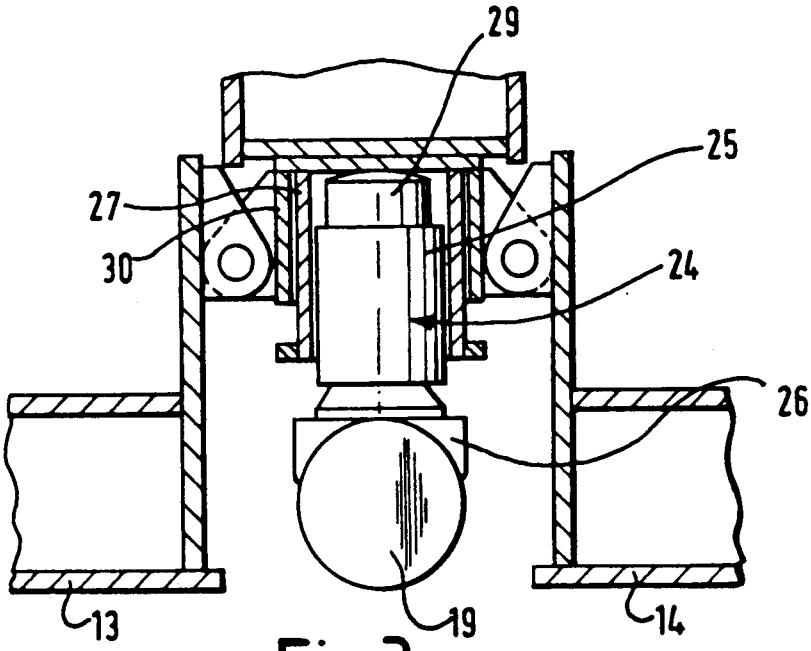
FIG. 3 is a view corresponding to FIG. 2, but showing the parts of the supports in a transportation position.

As the hydraulic legs of the support are fully retracted to collapse the support, a point is reached where the canopy bottom plate 39 comes into contact with the retention plate 28, as shown in FIG. 3. With prior art supports, maximum collapse of the support is reached at this point.

However, with the support according to this embodiment, the skids 13 and 14, i.e. the base 10, can continue relative movement towards the canopy 11 by relative upward sliding movement of the outer tube 30 until the outer tube 30 comes into contact with the projecting edge 31 of the retention plate 28. Thus a significant additional degree of compaction of the support is made possible.

The sheer flange 32 protects the ram 24 if a situation should accidentally arise where excessive load is applied to the ram 24. If for example the much more powerful main hydraulic legs should accidentally be extended, to force the canopy 11 into contact with the mine roof, while the ram 24 is still in its lifting position, the flange 32 would simply sheer off, removing load from the ram 24 and thus protecting it.

Many other configurations are possible. For example other forms of lost motion mechanisms may be used, and the supports may have any desired number of main legs. For instant four support legs may be used instead of two.

The reader's attention is directed to all papers and documents which are filed concurrently with or previous to this specification and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

I claim:

1. A mine roof support comprising:

a base including a pair of parallel skids each having a front end;

a roof canopy;

jack means acting between the base and canopy;

auxiliary jack means connected to said base for lifting or lowering at least part of said base when the support advances; and lost motion means connected between said base and said auxiliary jack means for aiding movement of said base and said roof engaging canopy towards each other, said lost motion means being connected to each of said skids by a pivotal connection which permits the front end of one skid to move vertically to a limited extent with respect to the front end of the adjacent skid.

2. A mine roof support as claimed in claim 1, in which said auxiliary jack means is arranged to act between part of a generally horizontally extending advancing means for advancing the support and an abutment member extending across and above said part of said generally horizontally extending advancing means.

3. A mine roof support as claimed in claim 2, in which said advancing means comprise an advancing ram and a relay bar.

4. A mine roof support as claimed in claim 2, in which said abutment member comprises a retention plate.

5. A mine roof support as claimed in claim 4, in which said auxiliary jack means comprises a generally cylindrical ram, said ram acting within a first housing, one end of which is bridged by said retention plate.

6. A mine roof support as claimed in claim 5, in which said lost motion is provided by a second housing which surrounds said first housing and is slidable therealong between a pair of stops.

7. A mine roof support as claimed in claim 6, in which said first and second housings comprise tubes.

8. A mine roof support as claimed in claim 7, in which one stop comprises an extension of said retention plate.

9. A mine roof support as claimed in claim 8, in which the second stop comprises a projection on said first housing.

10. A mine roof support as claimed in claim 9, in which said projection comprises an annular flange.

11. A mine roof support as claimed in claim 10, in which the annular flange or other projection is arranged to shear off if it is subjected to excess load, to protect said auxiliary jack means and said advancing means.

12. A mine roof support as claimed in claim 6, in which the pivotal connections are each formed by a projecting lug on said second housing which lug is connected by a pivot pin to a corresponding lug on said base.

13. A mine roof support as claimed in claim 1, in which the distance between the pivotal connections is fixed.

* * * * *